US006408660B1

(12) United States Patent
Lai

(10) Patent No.: US 6,408,660 B1
(45) Date of Patent: Jun. 25, 2002

(54) COMBINED LUGGAGE TAG AND LOCKING SYSTEM

(75) Inventor: Eric Lai, Sheung Shui (HK)

(73) Assignee: The Sun Lock Company LTD, Tuen Mun (HK)

( * ) Notice: Subject to any disclaimer, the term of this patent is extended or adjusted under 35 U.S.C. 154(b) by 0 days.

(21) Appl. No.: 09/752,363

(22) Filed: Dec. 29, 2000

(51) Int. Cl.[7] ..... E05B 37/06

(52) U.S. Cl. ..... 70/30; 70/18; 70/456 R; 40/6

(58) Field of Search ..... 70/30, 49, 14, 70/18, 38 A, 38 B, 38 C, 233, 456 R, 64, 69

(56) References Cited

U.S. PATENT DOCUMENTS 465,450 A * 12/1891 Brooke ..... 70/30
2,469,592 A * 5/1949 Byer ..... 70/65
3,719,974 A * 3/1973 Abrams et al. ..... 24/237
3,908,418 A * 9/1975 Stoffel ..... 70/456 R
3,961,431 A * 6/1976 Kalenian ..... 40/21 R
3,971,458 A * 7/1976 Koenig ..... 70/68 X
3,991,594 A * 11/1976 Goenner ..... 70/30
4,386,795 A * 6/1983 Charles et al. ..... 283/5
4,408,406 A * 10/1983 Barton ..... 40/19
4,610,152 A * 9/1986 Duringer ..... 70/30
4,616,435 A * 10/1986 Perfect ..... 40/6
5,311,690 A * 5/1994 Batten ..... 40/642
5,359,867 A * 11/1994 Ling et al. ..... 70/28
5,381,617 A * 1/1995 Schwartztol et al. ..... 40/6
5,440,904 A * 8/1995 Su ..... 70/18
5,505,064 A * 4/1996 Wang ..... 70/53
5,552,773 A * 9/1996 Kuhnert ..... 340/573
5,706,679 A * 1/1998 Zane et al. ..... 70/18
5,868,012 A * 2/1999 Chun-Te et al. ..... 70/30
5,896,762 A * 4/1999 Iadaka et al. ..... 70/18 X
6,050,622 A * 4/2000 Gustafson ..... 70/57.1 X
D439,825 S * 4/2001 Lai ..... D8/334
6,227,016 B1 * 5/2001 Yu ..... 70/30
D448,273 S * 9/2001 Lai ..... D8/333
6,299,323 B1 * 10/2001 Yu et al. ..... 362/116

* cited by examiner

*Primary Examiner*—Suzanne Dino Barrett
(74) *Attorney, Agent, or Firm*—Melvin I. Stoltz

(57) ABSTRACT

By providing a housing having an enlarged indicia receiving zone formed thereon along with combination defining rotatable dials associated therewith which controls lock means cooperatingly associated with the housing, a combined luggage tag and locking system is achieved. By employing this system, a single product is realized which is capable of identifying the owner of any suitcase or luggage with external indicia, while also effectively locking the suitcase or luggage to prevent unwanted entry. In addition, the combined luggage tag and locking system incorporates two separate and independent locking members, preferably a conventional shackle in combination with an elongated/flexible cable member or locking wire, for further enhancing the locked securement thereof to any desired product.

15 Claims, 5 Drawing Sheets

COMBINED LUGGAGE TAG AND LOCKING SYSTEM

TECHNICAL FIELD

This invention relates to luggage or name-bearing tags and, more particularly, to luggage or name-bearing tags constructed to incorporate at least one locking system integrally associated therein.

BACKGROUND ART

A wide variety of luggage or name-bearing tags have been developed and are widely employed by individuals to provide an immediate identification of the ownership of luggage which is being used during a trip. Typically, these prior art luggage tags comprise inexpensive plastic or paper components which are fastened to the handles of a suitcase using a simple connection system.

Although a wide variety of alternate constructions have been developed for luggage tags, these prior art systems have typically focused upon the single function of providing some identification of the owner in a simple to use and inexpensive construction. As a result of the inexpensive construction and simple fastening systems found in the prior art, luggage tags are often easily broken during use, having the luggage completely unidentified.

In addition to identifying their luggage, many individuals also wish to securely lock their suitcase in order to prevent unauthorized people from gaining access to the interior of the suitcase. In this regard, many lock constructions have been developed which typically either employ a key for opening the lock or employ rotatable dials which require knowledge of a preset combination in order to open the lock assembly. However, regardless of the particular construction employed for the lock, the lock is typically formed as a separate component mounted to the suitcase completely independently of the luggage tags.

A further problem typically found in prior art lock constructions is the presence of a single shackle or locking member. Typically, a generally j-shaped shackle is employed which is fixed in size and dimension. As a result, the shackle is capable of securely locking only specifically sized products and is incapable of being employed for products which are not able to fit within the dimensional limitations of the shackle.

In an attempt to eliminate this particular problem, some prior art combination locks have been constructed employing flexible cables as the locking means. Although the flexible cables employed in these prior art lock constructions do enable products of varying dimensions to be securely locked, these locks are limited by the length of the cable, as well as limited by incorporating a single locking member.

As is evident from these prior art products, a user is required to select and employ a separate luggage tag loosely attached to the suitcase and then select a particular lock construction depending upon the particular items the user desires to secure. As a result, the user is required to possess a wide variety of luggage tags as well as possess a wide variety of locks, each of which incorporate a different locking member in order to be capable of satisfying all of the needs of the user.

Therefore, it is a principal object of the present invention to provide a luggage tag which incorporates a locking system formed as an integral component of the luggage tag, thereby achieving a single, securely lockable, combined luggage tag and locking system.

Another object of the present invention is to provide a combined luggage tag and locking system having the characteristic features described above which incorporates two separate and independent locking members integrally formed with the luggage tag.

Another object of the present invention is to provide a combined luggage tag and locking system having the characteristic features described above which is capable of being easily employed by the user for externally identifying the ownership of the luggage while also securely locking the luggage in any desired location.

A further object of the present invention is to provide a combined luggage tag and locking system having the characteristic features described above wherein both separate and independent locking systems operate using the same combination lock assembly, thereby providing flexibility as well as ease of construction, assembly, and use.

Another object of the present invention is to provide a combined luggage tag and locking system having the characteristic features described above which employs a minimum of components and is quickly and easily assembled, thereby providing a luggage tag/locking system capable of being constructed at a competitive price.

Other and more specific object will impart the obvious and will impart appear hereinafter.

SUMMARY OF THE INVENTION

By employing the present invention, all of the difficulties and drawbacks of prior art products are virtually eliminated and an effective, easily produced, combined luggage tag and locking system is achieved. In the present invention, a single product is realized which is capable of identifying the owner of any suitcase or luggage with external indicia, while also effectively locking the suitcase or luggage to prevent any unwanted entry. Furthermore, the present invention substantially eliminates loss or dislodgement of the luggage tag from the suitcase.

In the preferred embodiment of the present invention, the combined luggage tag and locking system incorporates two separate and independent locking members, preferably a conventional shackle in combination with an elongated/flexible cable member or locking wire. Preferably, the elongated flexible cable member is removably mounted at one and of the luggage tag housing or assembly, while the shackle is mounted at the opposed end.

Furthermore, in order to provide the desired identification of the user, the combined luggage tag/locking system of the present invention incorporates an indicia receiving zone formed on a prominent, readily visible portion of the luggage tag housing. By employing this zone, the user is able to place any desired individualized information required for identification purposes to enable the owner of the luggage to be readily apparent. In addition, in the preferred construction, an overlying transparent, window is employed in cooperation with the indicia receiving zone for protecting the information placed thereon.

As is evident from the detailed disclosure provided herein, the present invention may be implemented in a plurality of alternate constructions and configurations. However, the preferred construction of the present invention employs an elongated slot formed at one end of the luggage tag housing with the slot being constructed for receiving and lockingly engaging and retaining both ends of the elongated flexible cable member. In addition to providing secure, locked, interengagement of the flexible cable member in the elongated slot, this construction also enables a user to completely remove the cable member from the luggage tag housing when use of the cable is not desired.

In addition, the preferred embodiment of the present invention incorporates a plurality of rotatable dials mounted in the housing of the luggage tag for establishing a secret combination known only to the user. The rotatable dials are constructed for cooperating with a movable locking plate internally mounted within the luggage tag housing. In the preferred configuration, the locking plate controls the locking of the shackle member and the opening and closing of the slot for engaging and disengaging the flexible cable member with the housing.

In carrying out the present invention, the elongated flexible cable member may be constructed in a wide variety of alternate configurations as well as with a wide variety of alternate fastening members mounted at its opposed ends. In addition, if desired, one end of the flexible cable can be securely mounted to the housing to prevent removability of the cable therefrom. Although a removable cable is preferred, as discussed above, this alternate construction is clearly within the scope of the present invention. Furthermore, the various locking structures or systems employing variations of the present invention are also intended to be within the scope of the present invention.

In the present invention, a minimum number of components are employed to form the combined luggage tag and locking system of this invention. In addition, although three rotating dials are employed in the present invention, any desired number of rotatable dials can be incorporated into the housing of the luggage tag without departing from the scope of this invention.

By employing the teaching of the present invention, a combined luggage tag and locking system is achieved using a minimum number of independent components, each of which is capable of being quickly assembled into the final product. As a result, a construction is obtained which is capable of being manufactured at a competitive price, while providing a high-quality, highly effective combined luggage tag and locking system which eliminates unauthorized people from opening a suitcase of the user, while also identifying the suitcase and preventing the luggage tag from being dislodged, disconnected, or removed therefrom.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

By referring to FIGS. 1–11, the preferred construction and operation of combined luggage tag and locking system 20 of the present invention can best be understood. In FIGS. 1–11, the preferred construction of the present invention is provided. However, as detailed above, numerous variations may be made in the present invention without departing from the scope of this invention. Consequently, it is to be understood that the embodiment shown in FIGS. 1–11 is provided for exemplary purposes only, and is not intended as a limitation of the present invention.

Figure 1:
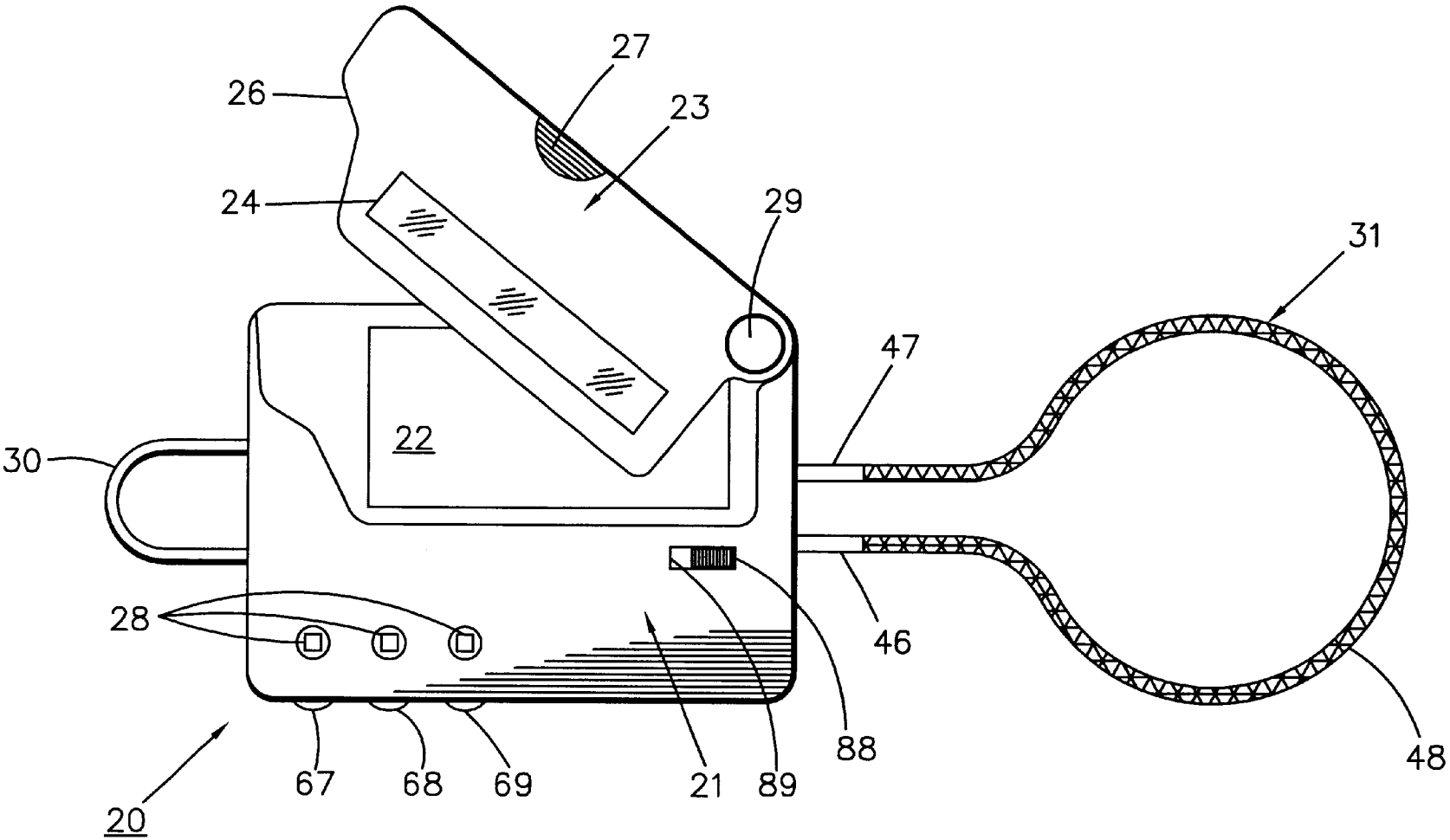
FIG. 1 is a top plan view depicting the fully assembled combined luggage tag and locking system of the present invention.
Figure 2:
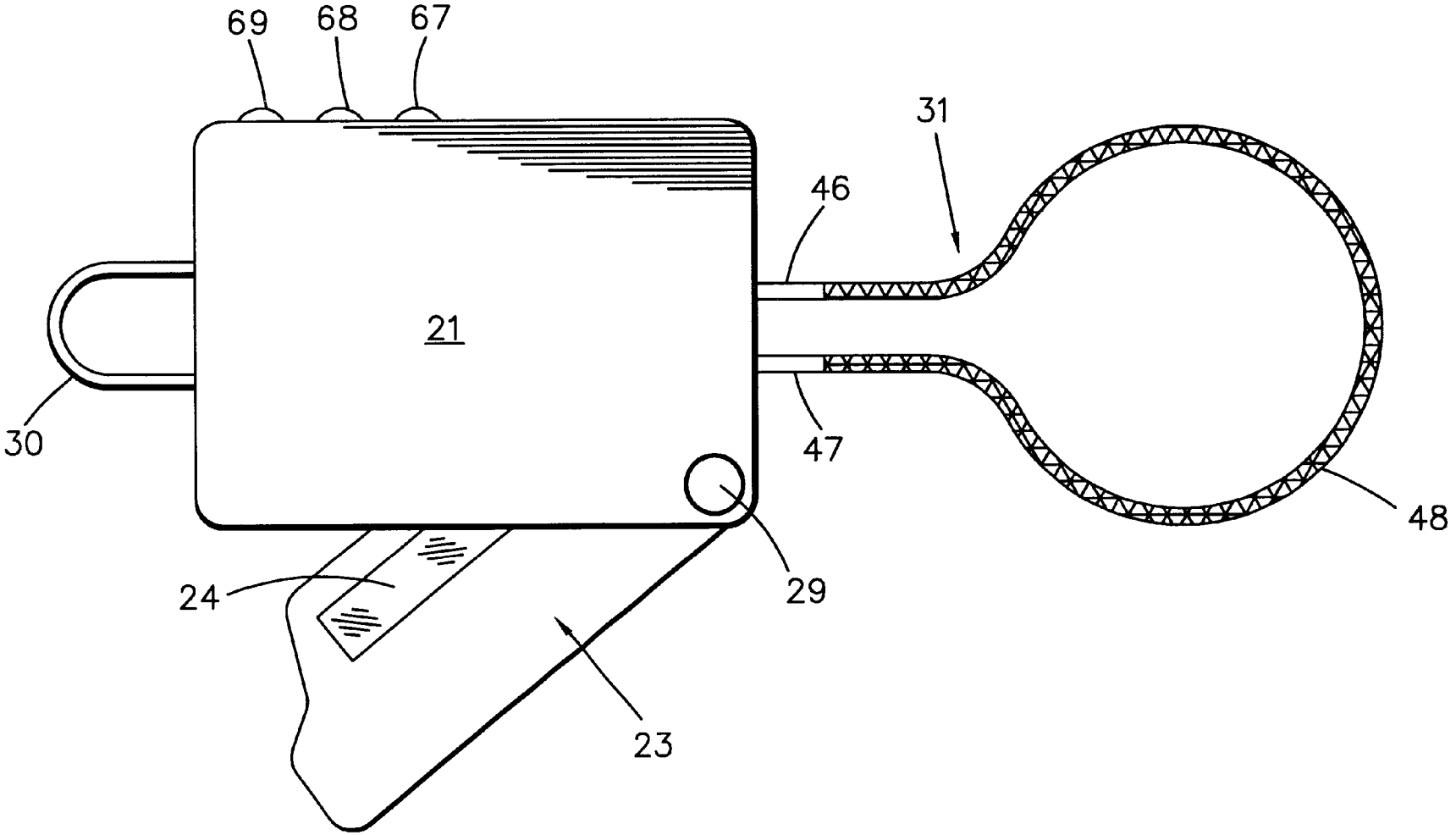
FIG. 2 is a bottom plan view of the fully assembled combined luggage tag and locking system of the present invention partially broken away.

As shown in FIGS. 1 and 2, combined luggage tag and locking system comprises a housing 21 on which indicia receiving zone 22 is formed. Preferably, indicia receiving zone 22 comprises an enlarged area of housing 21 in order to provide high visibility for the identifying information placed therein by the user. In this way, the user or owner of the luggage to which combined luggage tag/locking system 20 is secured can be easily identified.

In the preferred construction, combined luggage tag/locking system 20 incorporates plate 23 which is pivotally mounted to housing 21 and incorporates a transparent window 24. In this preferred embodiment, plate 23 is constructed for being easily pivoted about pivot pin 29 relative to housing 21 in order to provide access to indicia receiving zone 22. In this way, the user is able to place the desired identifying information therein. In addition, in normal use, plate 23 is pivoted into an overlying, covering relationship with indicia receiving zone 22, thereby protecting indicia receiving zone 22 and the information place therein from degradation from environmental conditions.

Furthermore, as stated above, in the preferred embodiment, plate 23 incorporates transparent window 24. By employing transparent window 24, an observer is able to quickly and easily identify and read the information placed in indicia receiving zone 22 so as to know the owner of the luggage to which combined luggage tag/locking system 20 is affixed, without requiring arcuate pivoting movement of plate 23.

In addition, in order to assure the securement of plate 23 in its closed position, locking means are employed, such as a raised zone or boss formed on housing 21 which cooperates with a recessed area 25 formed on plate 23. In the preferred construction, recessed area 25 is formed along flange 26 which extends from plate 24 and has a reduced thickness. In this way, housing 21 can incorporate a receiving a slot within which flange 26 is placed with recessed area 25 lockingly engaging the raised zone formed therein.

Furthermore, in the preferred construction, plate 23 also incorporates a plurality of ridges 27 formed along a side edge thereof to provide a slip-free surface. In this way, the user is able to easily access ridges 27 in order to obtain rapid frictional engagement with plate 23 for causing plate 23 to pivot relative to housing 21, whenever desired.

As is more fully detailed below, combination luggage tag/locking system 20 preferably comprises a plurality of indicia-bearing rotatable dials for setting and inputting a desired combination for locking and unlocking system 20. In order to enable the user to readily display any desired combination, housing 21 comprises a plurality of apertures 28 for displaying the indicia formed on the dials.

In order to provide the desired dual locking function, combination luggage tag/locking system 20 of the present invention incorporates a shackle 30 and a cable member 31. In the preferred embodiment, as best seen in FIG. 3, shackle 30 comprises a conventional J-shape incorporating a short leg 33 with a terminating end 34, and a long leg 35 having a terminating end portion or section 36.

In addition, terminating end portion 36 of long leg 35 is securely journaled in slider block 37 in a manner which enables shackle 30 to arcuately pivot or rotate about the central axis of long leg 35, while preventing terminating end portion 36 of leg 35 from being axially removed from block 37. As a result, any axial movement of leg 35 causes slider block 37 to move with shackle 30 relative to housing 21 of combination luggage tag/locking system 20.

Figure 3:
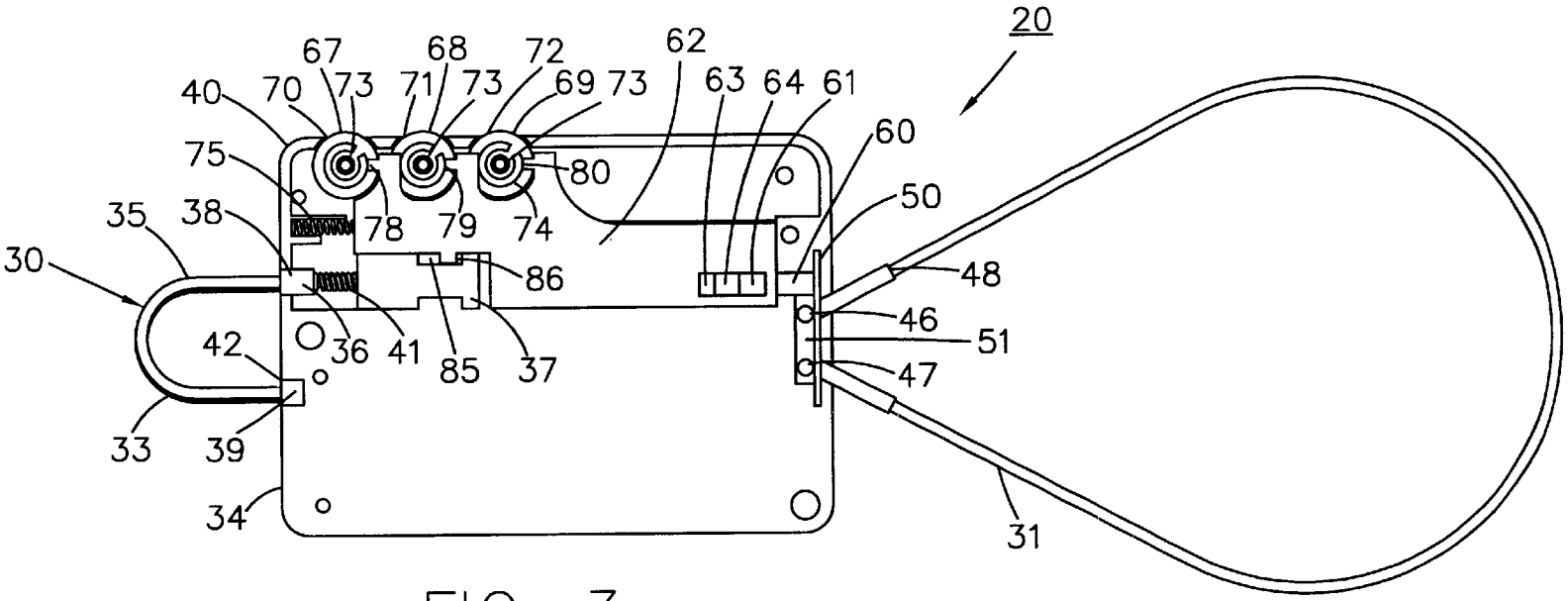
FIG. 3 is an enlarged bottom plan view similar to the view of FIG. 2 showing details of the internal construction of the fully assembled combined luggage tag and locking system of the present invention.

In the preferred embodiment, as depicted in FIG. 3, housing 21 of combination luggage tag/locking system 20 also comprises mounting blocks 38 and 39 which are formed for cooperative engagement with shackle 30. In the preferred construction, mounting block 38 incorporates a through hole or passageway 40 within which long leg 35 is slidingly mounted for axial movement relative thereto.

In addition, spring member 41 is mounted about the outer surface of leg 35 sandwiched between slider block 37 and mounting block 38. In this way, any axial movement of the shackle 30 causes spring member 41 to be compressed as slider block 37 compresses spring member 41 against mounting blocks 38 as shackle 35 is slidingly moved in a direction away from housing 21. In addition, once any removal force is eliminated, spring member 41 automatically causes shackle 30 to return to its original position.

In order to provide a secure, locked position for shackle 30, block 39 incorporates a cavity 42 formed therein dimensioned for receiving terminating end 34 of a short leg 33. Once terminating end 30 is secured in cavity 42 of mounting block 39, and combination luggage tag/locking system 20 is in its locked configuration, as detailed below, the secure engagement of the shackle 30 in the desired locked position is attained and any items mounted to shackle 30 are effectively locked.

In order to provide the second locking means for combination luggage tag/locking system 20, elongated cable or wire member 31 is lockingly engaged with housing 21. In the preferred construction, elongated flexible cable or wire member 31 comprises end caps 46 and 47, each of which are securely affixed to opposed ends of an elongated length of flexible, woven wire 48.

Although an elongated length of flexible woven wire is preferred, any alternate construction which provides a secure, fully integrated, flexible, nonbreakable or tamper resistant cable member can be employed with equal efficacy. In this way, regardless of the material employed, cable member 45 is capable of being extended and lockingly engaged with a plurality of alternate products, handles, suitcases, constructions, and configurations which shackle 30 would be incapable of lockingly engaging.

Figure 4:
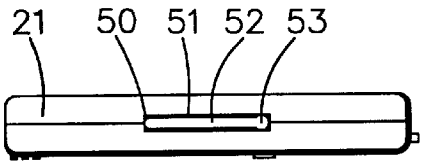
FIG. 4 is a bottom plan view of the fully assembled combined luggage tag and locking system of the present invention.

In the preferred construction, as shown in FIGS. 3 and 4, housing 21 incorporates an elongated opening 50 formed in the bottom edge thereof with plate member 51 mounted in opening 50, securely affixed therewith. In order to assure that plate member 51 is securely retained in housing 21 in association with opening 50, plate member 51 preferably comprises an overall length which is greater than the length of elongated opening 50. In this way, plate member 51 is securely retained and affixed to housing 21, in a manner which renders plate member 51 non-removable from housing 21.

In addition, in the preferred construction, plate member 51 comprises an elongated narrow slot 52 formed directly in plate member 51. In the preferred construction, the facing edges forming slot 52 are spaced apart a substantially equal distance throughout the overall length of slot 52. In addition, an enlarged zone 53 is formed at one terminating end of slot 52.

In order to enable cable member 31 to be removably lockingly engaged with housing 21 of combination luggage tag/locking system 20 of the present invention, end caps 46 and 47 of cable member 31 are constructed for being removably securely retained and lockingly mounted to housing 21 by plate member 51. In the preferred construction, this desired result is achieved by forming end caps 46 and 47 in a manner which enables each end cap 46 and 47 to be inserted through enlarged zone 53 and, once positioned in slot 52, end caps 46 and 47 are incapable of being removed from slot 52, except by authorized individuals. In this way, cable member 31 is securely affixed to housing 21 and the products through which cable member 31 has been positioned are retained in a closed and locked relationship.

In order to attain this result, end caps 46 and 47 may comprise a plurality of alternate constructions and configurations. However, in the preferred construction, as shown in FIG. 3, end caps 46 and 47 are constructed with a substantially cylindrical body portion 54 which is fixedly mounted to one end of flexible cable or wire member 48. In addition, a rod or finger portion 55 coaxially extends from body portion 54 and comprises a diameter less than the diameter of body portion 54. Finally, enlarged terminating end portion 56 is formed as the distal end of rod portion 55, comprising a generally rounded configuration and having a diameter substantially equal to the diameter of body portion 54.

By constructing end caps 46 and 47 in this manner, the desired cooperative locking engagement and unlocking disengagement of flexible cable assembly 31 from housing 21 is achieved. In this regard, the diameter employed for forming terminating end portion 56 is selected for enabling end portion 56 to enter enlarged zone 53.

In addition, rod or finger portion 55 comprises a diameter which enables rod portion 55 to be freely slidable along slot 52. However, since the width of slot 52 is substantially less than the diameter of enlarged zone 53, terminating end portion 56 is incapable of being withdrawn through slot 52. As a result, cable member 31 is securely affixed and lockingly retained in plate member 51, once end caps 46 and 47 have been inserted therein and positioned along slot 52.

In order to provide the desired secure, locking retention of cable member 31 in slot 52 of plate member 51, combination luggage tag/locking system 20 incorporates movable abutment post 60 mounted in housing 21. As shown in FIG. 3, abutment post 60 comprises a terminating end portion 61 which is positioned in direct, locking engagement with enlarged zone 53 of plate member 51 when post 60 is in its first and normal position. Whenever terminating end portion 61 is in this position, as depicted in FIG. 3, access through enlarged zone 53 of plate member 51 is prevented. Consequently, end caps 46 and 47 are incapable of being removed from slot 52 whenever post 60 is in its first and normal position.

In the preferred construction, however, abutment post 60 is movable between its first position wherein end caps 46 and 47 are lockingly retained in housing 21, and a second position wherein end caps 46 and 47 are removable from housing 21. As depicted in FIG. 3, when abutment post 60 is in its first position, terminating end portion 61 blocks access to enlarged zone 53, preventing the movement of end caps 46 and 47 through enlarged zone 53. However, when abutment post 60 is moved to its second position, abutment post 60 is moved towards shackle 30 a sufficient distance to remove terminating end portion 61 from blocking enlarged zone 53, thereby enabling end caps 46 and 47 to be moved through enlarged zone 53 and removed from housing 21.

In the preferred construction, movable abutment post 60 is constructed for cooperating controlled engagement with locking plate 62, the construction and operation of which is fully detailed below. In providing abutment post 60 with the desired movability, locking plate 62 incorporates a receiving slot 63 within which a portion of abutment post 60 is longitudinally movable.

In order to maintain abutment post 60 in a normally closed, first position, wherein abutment post 60 blocks enlarged zone 53, spring member 64 is mounted in slot 63 in direct engagement with the opposed terminating end of abutment post 60. In this way, spring member 64, which is maintained under compression, exerts its force on abutment post 60, forcing abutment post 60 into contact with plate member 61 for blocking enlarged zone 53.

The desired, user-controlled locking and unlocking of shackle 30 and cable member 31 of combined luggage tag/locking system 20 of the present invention is provided by incorporating locking plate 62 in combination with rotatable dials 67, 68, and 69, each of which are mounted in cooperating association with one clutch ring 70, 71, or 72. Furthermore, in order to maintain clutch rings 70, 71 and 72 in frictional engagement with dials 67, 68 and 69, a spring member 73 is coaxially associated with each assembly to provide the required biasing force for maintaining each clutch ring in continuous frictional engagement with its associated dial. In this way, rotational movement of dials 67, 68 and 69 about their central axis causes clutch rings 70, 71 and 72 to rotationally move therewith.

Although the detailed construction and operation of dials 67,68 and 69, and clutch rings 70, 71 and 72 are fully detailed below, one structural feature which is important to note is the incorporation of a slot 74 formed in each clutch ring 70, 71 and 72. As fully detailed herein, slot 74 of each clutch ring controls the locking and unlocking of combined luggage tag/locking system 20 in combination with the rotation of dials 67, 68 and 69.

In its preferred construction, locking plate 62 comprises a generally rectangular shape, extending substantially the entire length of housing 21. In this way, locking plate 62 is capable of controlled engagement with shackle 30, cable member 31, and clutch rings 70, 71 and 72. In addition, in the preferred construction, locking plate 62 is constructed for sliding movement within housing 21.

In order to maintain locking plate 62 in its first position, spring member 75 is employed, mounted between the top edge of housing 21 and a side edge of locking plate 62. With spring member 75 mounted under compression, locking plate 62 is continuously biased towards the bottom edge of housing 21, requiring a movement force to be exerted in order to cause locking plate 62 to move from its first position to its second position.

In addition to requiring a movement force for causing locking plate 62 to be moved from its first position to its second position, each clutch ring 70, 71 and 72 must be placed in a precisely desired orientation or position. As shown in FIG. 3, locking plate 62 incorporates fingers 78, 79 and 80 formed thereon and dimensioned for sliding engagement with slots 74 of clutch ring 70, 71 and 72.

As a result, each slot 74 of each clutch ring 70, 71 and 72 must be positioned in juxtaposed, spaced, cooperating relationship with fingers 78, 79 and 80 before locking plate 62 is capable of being moved from its first position into its second position. If any clutch ring 70, 71 or 72 is positioned with its slot 74 arcuately spaced away from alignment with fingers 78, 79 or 80, movement of locking plate 62 is prevented.

In the preferred embodiment of the present invention, the required movement force for causing locking plate 62 to move from its first position to its second position is provided by the user opening either shackle 30 or cable member 31. As detailed above, this movement is attainable only when clutch rings 70, 71 and 72 are placed in the precisely required position, with each slot aligned with fingers 78, 79 and 80. As fully discussed below, this position is obtained only when the preset combination of combined luggage tag/locking system 20 has been properly entered.

When that the preset combination has been properly entered on dials 67, 68, and 69, slot 74 of clutch ring 70, 71 and 72 are positioned in juxtaposed, spaced alignment with fingers 78, 79 and 80 of locking plate 62. As a result, locking plate 62 is able to be moved from its first position to its second position. In order to override the force of spring member 75, and cause locking plate 62 to move from its first position to its second position, either shackle 30 or abutment post 60 must be activated.

In activating or opening shackle 30, shackle member 30 is pulled by the user in an attempt to withdraw terminating end 34 of short leg 33 from cavity 42. This movement simultaneously causes long leg 35 to move axially relative to hole 40 of block 38. Since terminating end of portion 36 of shackle 30 is securely mounted to slider block 37, axial movement of long leg 35 causes slider block 37 to move therewith. As shown in FIG. 3, slider block 37 incorporates a notched area 85 with finger 86 of locking plate 62 being positioned in notched area 85. As a result, the longitudinal, sliding movement of slider block 37 causes notched area 85 to contact finger 86, which in turn causes finger 86 and its associated locking plate 62 to move therewith.

Clearly, whenever one or more clutch rings 70, 71 and 72 are positioned with slot 74 oriented away from fingers 78, 79, or 80, finger member 86 and locking plate 62 are incapable of being moved, resulting in shackle 30 being securely retained in its locked position. However, whenever slots 74 of clutch rings 70, 71 and 72 are aligned with fingers 78, 79 and 80, movement of locking plate 62 is possible. As a result, the desired locking and unlocking of shackle 30 is quickly and easily obtained by only authorized persons were capable of placing dials 67, 68, and 69 in the precisely desired orientation for positioning slot 74 of clutch ring 70, 71 and 72 in the aligned position.

As detailed above, elongated abutment post 60 is mounted in cooperative engagement with a locking plate 62 in a manner wherein the longitudinal movement of abutment post 60 is prevented by locking plate 62. However, whenever slots 74 of clutch ring 70, 71 and 72 are aligned with fingers 78, 79 and 80 of locking plate 62, longitudinal movement of abutment post 60 is allowed with abutment post 60 causing locking plate 62 to move from its first position to its second position. As detailed above, whenever abutment post 60 is moved into its second position, engagement or disengagement of cable member 31 is allowed.

In order to provide ease of operation by a user, abutment post 60 incorporates a readily accessible, raised slider 88 formed as an integral part of abutment post 60. In addition, raised slider 88 is positioned in cooperating association with slot 89 formed on the top surface of housing 21. As a result, whenever dials 67, 68 and 69 are placed in position for opening combined luggage tag/locking system 20, a user wishing to employ cable member 31 merely contacts slider 88, moving slider 88 from its first position to its second position in slot 89. This movement causes abutment post 60 to move simultaneously therewith, removing terminating end portion 61 from locking engagement with enlarged zone 53 of plate member 51.

As a result, the desired access to cable member 31 is easily achieved. Once all of the items to be secured by cable member 31 have been engaged with cable member 31, end caps 46 and 47 of cable member 31 are placed in slot 52, with abutment post 60 being returned to its original position. Then, dials 67, 68 and 69 are rotated so as to cause slots 74 of clutch rings 70, 71 and 72 to be moved out of alignment with fingers 78, 79 and 80 of locking plate 62. This assures that the desired secure, locked engagement of cable member 31 with housing 21 is realized.

Figure 7:
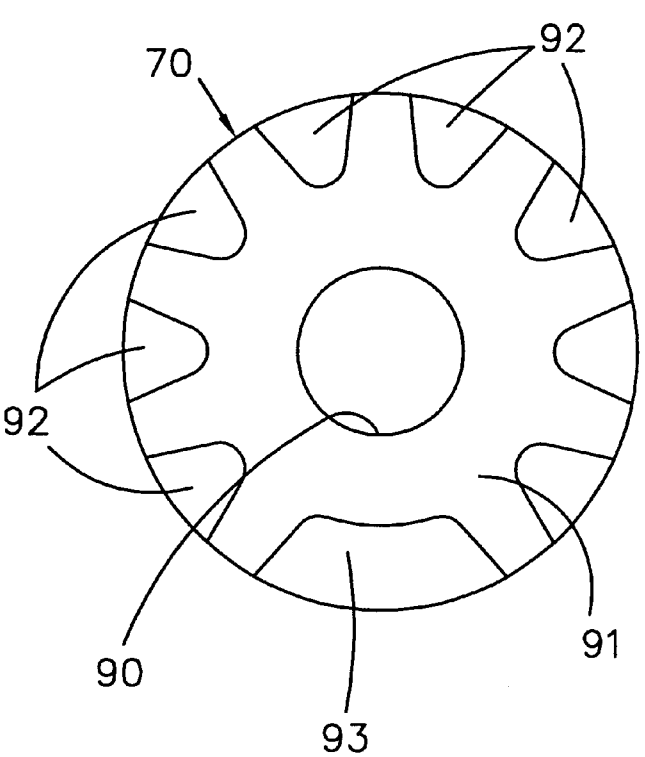
FIG. 7 is a top plan view of the clutch ring of FIG. 5.
Figure 6:
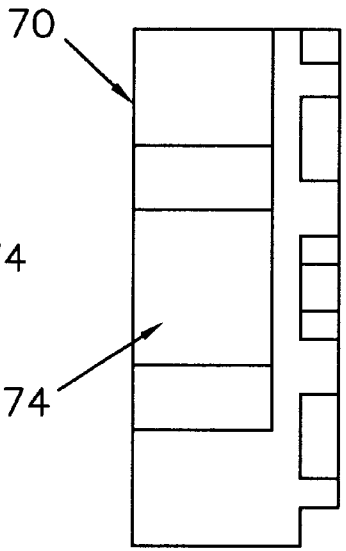
FIG. 6 is a side view of the clutch ring of FIG. 5.
Figure 5:
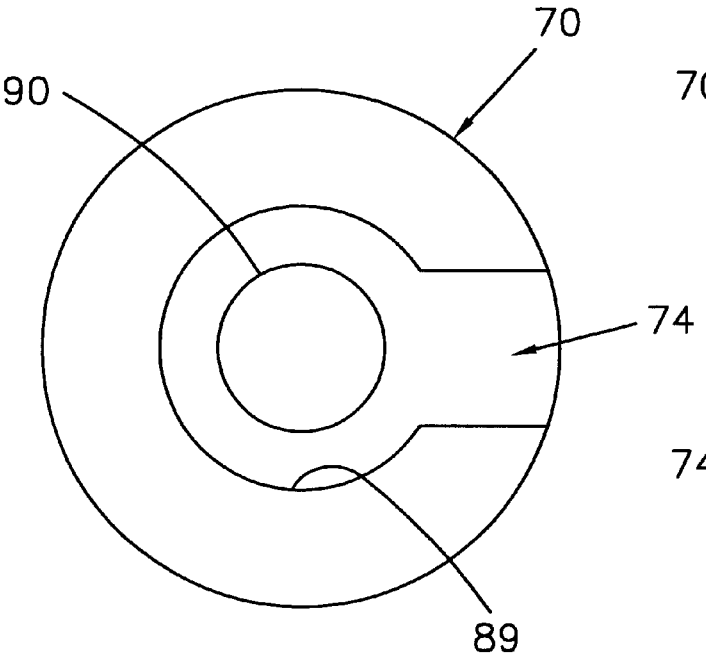
FIG. 5 is a bottom plan view of a clutch ring employed in the combined luggage tag and locking system of the present invention.
Figure 10:
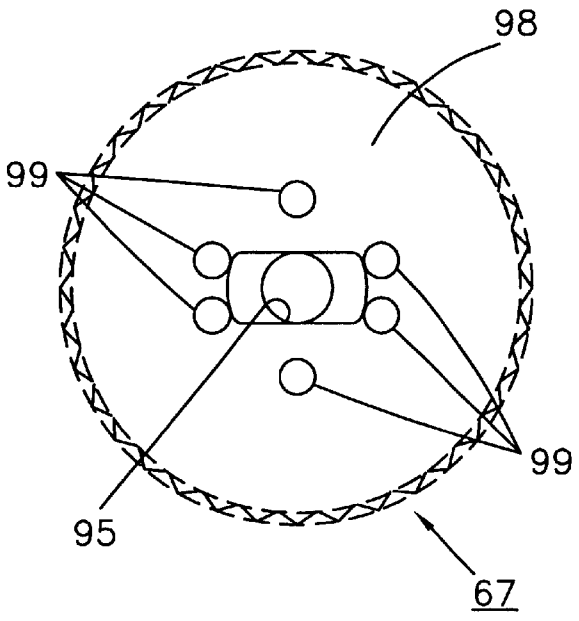
FIG. 10 is a bottom plan view of the dial of FIG. 8.
Figure 9:
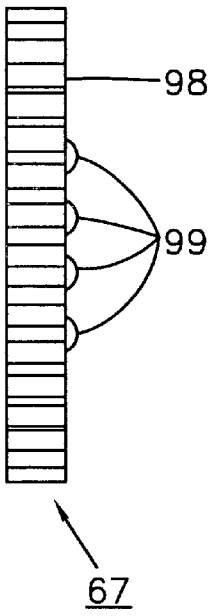
FIG. 9 is a side view of the dial of FIG. 8.
Figure 8:
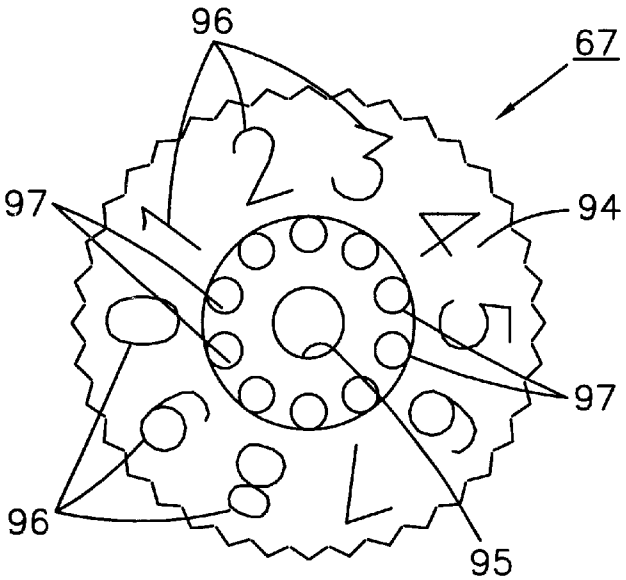
FIG. 8 is a top plan view of a dial employed in the combined luggage tag and locking system of the present invention.

In FIGS. 5, 6 and 7, the construction of clutch ring 70 is fully shown, while FIGS. 8, 9 and 10 fully depict the construction of dial 67. By referring to these figures, along with the following detailed discussion, the construction and operation of clutch rings 70, 71 and 72 and dials 67, 68 and 69 can best be understood, since each clutch ring and each dial are identical in construction in use.

In this preferred construction, clutch ring 70 comprises a generally circular shape having a diameter which is less than the diameter of dial 67. In addition, a first, centrally disposed, circular hole 90 is formed in clutch ring 70 along with a second centrally disposed circular hole 89 having a diameter greater than hole 90. Both holes 89 and 90 are aligned with the central axis of clutch ring 70.

Furthermore, as detailed above, slot 74 is formed in clutch ring 70 extending from the outer surface of clutch ring 70 to hole 89.

As shown in FIG. 7, clutch ring 70 comprises a dial contacting surface 91, with dial contacting surface 91 incorporating a plurality of notched zones 92 formed about the entire outer peripheral surface of clutch ring 70 and an enlarged notched zone 93. In the preferred embodiment, each notch zone 92 is substantially identical to each other and is formed in a generally U-shape.

As shown in FIGS. 8–10, dial 67 comprises a generally circular shape having an overall diameter greater than the diameter of clutch ring 70 and incorporating a centrally disposed circular hole 95, coaxially aligned with the center of dial 67. In addition, dial 67 incorporates a top surface 94 on which a plurality of indicia 96 are formed for ease of visibility. In the preferred embodiment, indicia 96 comprises numerals ranging from 0 through 9, with each numeral being placed adjacent each other in substantially equal spaced intervals. Finally, top surface 94 comprises a plurality of substantially circular shape recess zones 97 formed about hole 95 in a generally circular configuration.

As shown in FIG. 10, dial 67 comprises a bottom surface 98 on which a plurality of raised the bumps or bosses 99 are formed in spaced relationship with hole 95. Although the construction, position, and configuration of raised bumps 99 can be varied or altered depending upon particular goals and objectives being sought, the general configuration of raised bumps 99 are designed for cooperative engagement with notched zones 92 and 93 of clutch ring 70.

By properly constructing raised bumps 99 and notched zones 92 and 93, locked interengagement of clutch ring 70 with a dial 67 is attained, as well as independent rotational movement of each component relative to the other. In this way, as is more fully detailed below, any desired combination can be preset for opening combined luggage tag/locking system 20 using a construction which is reasonably inexpensive to produce, while providing highly reliable results.

Figure 11:
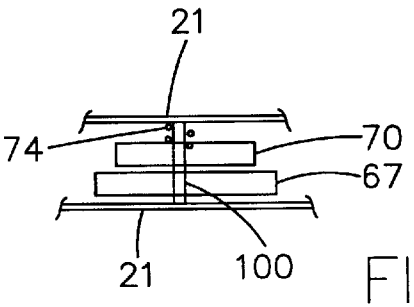
FIG. 11 is a cross-sectional side elevation view of the clutch ring and dial assembly taken along line 11—11 of FIG. 3.

By referring to FIG. 11, along with the following detailed discussion, the cooperative engagement and operation of dials 67,68 and 69 along with clutch ring 70, 71 and 72 can best be understood. For ease and simplicity, one single assembly is depicted in FIG. 9, with the following discussion having equal efficacy to each of the other assemblies.

As shown in FIG. 11, dial 67 is mounted on post 100 which is formed as part of housing 21. The diameter of post 100 is constructed for cooperating with hole 95 of dial 67 and hole 90 of clutch ring 70. By employing complementary diameters for each of these components, dial 67 and clutch ring 70 are easily mounted about post 100 and freely rotatable about post 100. In addition, as shown in FIG. 11, dial 67 is mounted on post 100. with surface 91 of clutch ring 70 mounted in contacting engagement with surface 98 of dial 67. The assembly of these components is completed by mounting spring member 75 on post 100 in hole 89 in biasing, contacting engagement with clutch ring 70.

As stated above, hole 89 of clutch ring 70 comprises a diameter larger than hole 90 to enable spring member 75 to be placed in hole 89, freely surrounding post 100 and extending therefrom. Once housing 21 is closed and sealed, spring member 100 is maintained under compression, exerting a biasing force against clutch ring 70, assuring that clutch ring 70 is continuously urged into frictional engagement with the dial 67. By employing this construction, the rotational movement of dial 67 by the user causes clutch ring 70 to rotate simultaneously therewith.

By employing the construction detailed above, the user is able to quickly and easily unlock and lock either shackle 30 or cable member 31. In order to place combination luggage tag/locking system 20 in the unlocked or open position, dials 67, 68, and 69 are rotated about the axis defined by post 100 of housing 21 until the pre-selected, combination-defining indicia 96 formed on dials 67, 68 and 69 appear through apertures 28 formed in housing 21.

As detailed above, since clutch rings 70, 71 and 72 are biased into frictional engagement with dials 67, 68 and 69, the rotation of dials 67, 68 and 69 causes clutch rings 70, 71 and 72 to rotate therewith. Consequently, the position of slots 74 of each clutch rings 70, 71 and 72 are placed in the desired aligned position with fingers 78, 79 and 80 of locking plate 72 whenever the preset combination indicia of dials 67, 68 and 69 are placed in the proper orientation. Once the indicia representing the preset combination are properly positioned, the movement of locking plate 62 is enabled and shackle 30 as well as cable member 31 can be freely removed from locked engagement with housing 21 for enabling in the desired use.

In addition, the construction detailed allows the user to individually select any desired combination for luggage tag/locking system 20 and input the desired combination to system 20 prior to use. In order to attain this result, the user places the indicia 96 on dials 67, 68 and 69 in the existing combination and then locks clutch rings 70, 71 and 72 by advancing slider 88 in slot 89. As detailed above, the movement of slider 88 causes fingers 78, 79 and 80 of locking plate 62 to engage slots 74 of clutch rings 70, 71 and 72, thereby preventing clutch rings 70, 71 and 72 from rotating.

By maintaining clutch rings 70, 71 and 72 in this locked position, the user rotates dials 67, 68, and 69 until any desired indicia 96 appear through apertures 28 of housing 21. Once the indicia representing a new combination are displayed in apertures 28, the user releases slider 88, thereby disengaging clutch rings 70, 71 and 72 from their locked position.

Although clutch rings 70, 71 and 72 are biased into frictional engagement with dials 67, 68 and 69 by spring members 73, clutch rings 70, 71 and 72 are incapable of being rotated by dials 67, 68 and 69 when the clutch rings are held in position by locking plate 62. As a result, the user is able to overcome the frictional engagement between clutch rings 70, 71 and 72 and dials 67, 68 and 69, enabling dial 67, 68 and 69 to be rotated relative to clutch rings 70, 71 and 72 for altering indicia 96 displayed through apertures 28 of housing 21. In this way, any desired combination can be inputted into luggage tag/locking system 20 of the present invention.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

Having described my invention, what I claim as new and desire to secure by Letters Patent is:

1. A combination luggage tag and locking system constructed to provide user identification and secure, locked engagement of any desired product, said system comprising A. a housing comprising an outer surface on which an enlarged indicia receiving and displaying zone is formed;

B. a plate member pivotally mounted to the housing and movable between a first position in overlying protective relationship with the indicia receiving/displaying zone and a second position wherein said plate member is arcuately pivoted relative to the housing to provide access to the indicia receiving/displaying zone;

C. a shackle mounted to the housing and movable between a first locked position and a second unlocked position, said shackle comprising a generally J-shape incorporating a. a short length having a terminating end constructed for cooperative locking and unlocking interengagement with the housing, and b. a long leg having a terminating end portion journaled in a slider block for enabling rotational movement of the long leg about a central axis while preventing axial removal of the long leg from the slider block;

D. an elongated, substantially continuous cable member constructed for cooperating locking engagement with the housing and disengagement from the housing;

E. a plurality of dials each of said dials being rotationally mounted to the housing for ease of access and rotational movement relative to the housing;

F. a plurality of clutch rings each being rotationally mounted to the housing in overlying engagement with one of said dials and constructed for rotational movement with the rotational movement of the associated dial during the normal operation, and comprising a slot constructed for cooperative engagement with a locking finger; and G. a locking plate mounted in the housing and movable between a first position cooperatively associative with the slider block of the shackle and the elongated flexible cable member to maintain the shackle and the cable member in secure, locked interengagement with the housing and a second position wherein the shackle and the cable member are unlocked and removable from the housing, said second position only being attainable by positioning the slots of each clutch ring in a precisely required orientation;

whereby a combination luggage tag and locking system is attained which is capable of enabling the user to provide identifying indicia on the surface thereof while also being able to securely lock a wide variety of products using either the shackle or the cable member.

2. The combination luggage tag and locking system defined in claim 1, wherein said plate member incorporates a transparent window zone for enabling the indicia to be easily viewable when the plate member is in a first position.

3. The combination luggage tag and locking system defined in claim 1, wherein said locking plate comprises a plurality of finger members positioned for engagement in the slots of the clutch rings whenever the clutch rings are rotated to position said slots in juxtaposed, facing relationship with the fingers, allowing said locking plate to move from a first position to a second position.

4. The combination luggage tag and locking system defined in claim 3 and further comprising a spring member mounted under compression between the housing and the locking plate for maintaining the locking plate in a first position.

5. The combination luggage tag and locking system defined in claim 4 and further comprising a plurality of spring members mounted to each clutch ring to assure biased engagement of the clutch ring to the dial, assuring simultaneous rotational movement of the clutch ring with the dial.

6. The combination luggage tag and locking system defined in claim 5, wherein each of said dials comprise a plurality of indicia formed on an outer, readily visible surface thereof for establishing a combination defining position wherein the slot of the clutch ring is positioned for receipt of the finger of the locking plate.

7. The combination luggage tag and locking system defined in claim 6, wherein the locking plate is movable from a first locked position to a second unlocked position whenever the indicia of each dial is positioned in the selected location for placing each slot of each clutch ring in juxtaposed aligned relationship with the fingers of the locking plate.

8. The combination luggage tag and locking system defined in claim 7, wherein the locking plate comprises an interlocking post for engaging the slider block of the shackle and controlling the movement of the shackle thereby.

9. The combination luggage tag and locking system defined in claim 8, wherein the locking plate cooperates with a movable post for controlling entry to the cable member receiving slot by blocking entry and enabling entry in response to the movement of the locking post.

10. The combination luggage tag and locking system defined in claim 1, wherein said housing comprises an elongated slot formed in one edge thereof and the cable member comprises a. an elongated, substantially continuous length of cable having a first end and a second, and b. said first end and said second end being removably mountable to the housing in cooperating relationship with the elongated slot of said housing.

11. The combination luggage tag and locking system defined in claim 10, wherein the locking plate is constructed for blocking entry into the slot when in a first position and enabling entry into the slot when in a second position, enabling entry and removal of the first end and second end of the cable member when desired.

12. The combination luggage tag and locking system defined in claim 11, wherein the slot comprises an elongated narrow portion and an enlarged cable member receiving portion associated therewith for enabling the first and second end portions to be inserted in and withdrawn from said slot.

13. The combination luggage tag and locking system defined in claim 10, wherein said cable member is further defined as comprising material resistant to being broken or severed.

14. The combination luggage tag and locking system defined in claim 13, wherein said cable member is further defined as being formed from braided or woven wire fibers.

15. The combination luggage tag and locking system defined in claim 14, wherein both the first end and the second end of the flexible cable assembly are slidably engaged and lockingly retained in elongated slots of the housing in response to movement of the locking plate between two alternate positions.

* * * * *